US007862040B2

(12) United States Patent
Dos Santos et al.

(10) Patent No.: US 7,862,040 B2
(45) Date of Patent: Jan. 4, 2011

(54) ITEM FEEDER WITH OVERTHICKNESS DETECTION

(75) Inventors: Luciano P. Dos Santos, Danbury, CT (US); Anthony P. Muffatti, Bethel, CT (US); Norman C. Allie, Ridgefield, CT (US)

(73) Assignee: Pitney Bowes Inc., Stamford, CT (US)

( * ) Notice: Subject to any disclaimer, the term of this patent is extended or adjusted under 35 U.S.C. 154(b) by 94 days.

(21) Appl. No.: 12/341,831

(22) Filed: Dec. 22, 2008

(65) Prior Publication Data

US 2010/0156027 A1 Jun. 24, 2010

(51) Int. Cl.
*B65H 7/12* (2006.01)

(52) U.S. Cl. ..... 271/262; 271/263; 271/265.04

(58) Field of Classification Search ..... 271/262, 271/263, 265.04; 198/502.2
See application file for complete search history.

(56) References Cited

U.S. PATENT DOCUMENTS 3,244,971 A * 4/1966 Thompson ..... 324/231
5,358,235 A * 10/1994 Konno et al. ..... 271/227
6,561,509 B2 * 5/2003 Kettenmann et al. ..... 271/263
2003/0141653 A1 * 7/2003 Kumamoto et al. ..... 271/262
2005/0212200 A1 * 9/2005 Van Nice et al. ..... 271/265.04

* cited by examiner

*Primary Examiner*—David H Bollinger
(74) *Attorney, Agent, or Firm*—Michael J. Cummings; Angelo N. Chaclas

(57) ABSTRACT

An item feeder includes a deck for supporting items, a transport element for transporting the items along the deck on a transport path from an upstream loading area through a downstream receiving passage, a drive element for driving the transport element, and a cover element comprising a leading edge. The cover element may be movable between a closed position in which the leading edge is disposed at a first distance from the deck, and an open position in which the leading edge is disposed at a second greater distance from the deck. The leading edge may engage transported items having a thickness greater than the first distance to move the cover element out of the closed position. The item feeder further includes a controller for controlling the drive element, wherein the controller is configured to stop the drive element when the cover element is moved out of the closed position.

14 Claims, 6 Drawing Sheets

ITEM FEEDER WITH OVERTHICKNESS DETECTION

FIELD OF THE INVENTION

The present invention relates to an item feeder and, more particularly, to an item feeder configured to detect items having a thickness greater than a predetermined value.

BACKGROUND OF THE INVENTION

Item transport systems, such as mailpiece handling systems, for example, are known in the art. These systems include inserter systems, which create mailpieces and prepare them for mailing, as well as sortation systems, which sort completed mailpieces and direct the mailpieces to storage pockets or bins, depending on the system's configuration. Sortation of mailpieces may be carried out either prior to mailing (i.e., outsorting) or upon receipt from a postal carrier (i.e., insorting). Other types of transport systems and related applications are known.

In some mailpiece handling systems, mailpieces are transported using belts or chain drives between stations where they undergo various types of processing. The processing may include cutting, folding, scanning, weighing, printing, and labeling, for example.

Some systems are configured to process mailpieces of different sizes and/or different types. In one example, a sortation system may be configured to process envelopes of different sizes. Other systems may be configured to process different types of mailpieces, such as envelopes, postcards, magazines, and catalogs, for example.

Although such systems have the ability to process mailpieces of different types and sizes, most systems have an upper limit on the thickness of the mailpieces they are capable of processing. The upper limit may be dictated by the dimensions of the various processing elements in the system, as well as the features of the transport elements of the system, such as nip dimensions, for example.

In some cases, mailpieces that exceed a system's maximum design thickness may be provided to the system for processing. Those mailpieces may cause jams or malfunctions in the system or may damage the system's components. Shutdowns associated with system malfunctions decrease the system's operating efficiency.

Efforts are currently made to remove excessively thick mailpieces from the mailpiece input stream. In association with those removal efforts, other mailpieces that merely appear to exceed the system's design thickness may be removed from the mailpiece input stream. Often, mailpieces are within a system's processing range, but are covered with loose wrapping material, for example, that gives the impression of excessive thickness. Removal of those mailpieces also reduces the system's efficiency.

SUMMARY OF EXEMPLARY ASPECTS

In the following description, certain aspects and embodiments of the present invention will become evident. It should be understood that the invention, in its broadest sense, could be practiced without having one or more features of these aspects and embodiments. It should also be understood that these aspects and embodiments are merely exemplary.

In accordance with the purpose of the invention, as embodied and broadly described herein, one aspect of the invention relates to an item feeder comprising a deck for supporting items, a transport element for transporting the items along the deck on a transport path from an upstream loading area through a downstream receiving passage, a drive element for driving the transport element, and a cover element comprising a leading edge. The cover element may be movable between a closed position in which the leading edge is disposed at a first distance from the deck, and an open position in which the leading edge is disposed at a second greater distance from the deck. The leading edge may be configured to engage transported items having a thickness greater than the first distance to move the cover element out of the closed position. The item feeder further comprises a controller for controlling the drive element, wherein the controller is configured to stop the drive element when the cover element is moved out of the closed position.

As used herein, "items" include papers, documents, postcards, envelopes, brochures, enclosures, booklets, magazines, media items, including CDs, DVDs, computer disks, and/or other digital storage media, and packages having a range of sizes and materials. The items may be unwrapped or may be covered with a wrapping material such as paper, a polymer wrap, such as polyethylene, for example, or other wrapping material.

In another aspect, the invention relates to a method of feeding items comprising supporting items on a deck, transporting the items along the deck on a transport path from an upstream loading area through a downstream receiving passage using a transport element, driving the transport element using a drive element, providing a cover element comprising a leading edge. The cover element may be movable between a closed position in which the leading edge is disposed at a first distance from the deck, and an open position in which the leading edge is disposed at a second greater distance from the deck. The leading edge may be configured to engage transported items having a thickness greater than the first distance to move the cover element out of the closed position. The method further comprises controlling the drive element using a controller, wherein the controller is configured to stop the drive element when the cover element is moved out of the closed position.

Aside from the structural and procedural arrangements set forth above, the invention could include a number of other arrangements, such as those explained hereinafter. It is to be understood that both the foregoing description and the following description are exemplary only.

BRIEF DESCRIPTION OF THE DRAWINGS

The accompanying drawings, which are incorporated in and constitute a part of this specification, illustrate exemplary embodiments of the invention and, together with the description, serve to explain the principles of the invention. In the drawings.

DETAILED DESCRIPTION OF EXEMPLARY EMBODIMENTS

Reference will now be made in detail to exemplary embodiments of the invention, examples of which are illustrated in the accompanying drawings. Wherever possible, the same reference numbers will be used throughout the drawings to refer to the same or like parts.

Embodiments of the invention are described with reference to certain applications in mailpiece sortation systems. It should be understood, however, that the invention may be used in association with other systems configured to handle and transport items. Further, many sortation systems are modular and may include more or fewer modules than those described herein based on the particular application.

Figure 1:
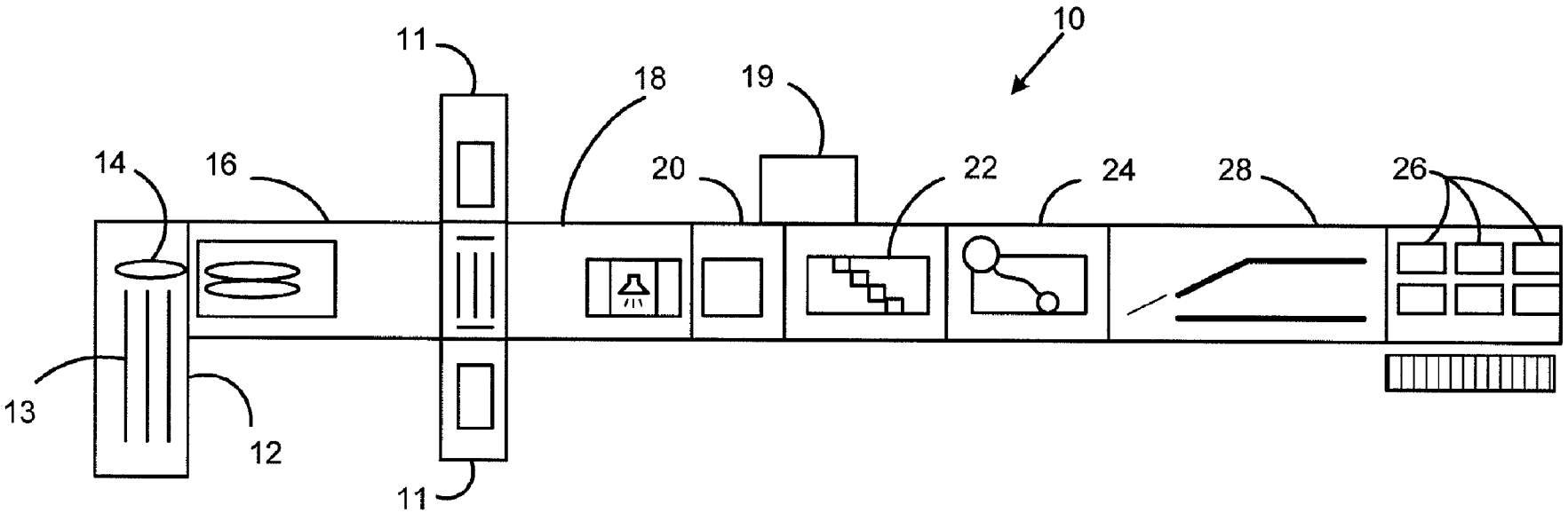
FIG. 1 is a schematic view of a sortation system utilizing an embodiment of the item feeder of the present invention.

A sortation system 10 utilizing an embodiment of the item feeder 11 according to the invention is shown in FIG. 1. The sortation system 10 includes an automatic feeder module 12 for feeding relatively thin, consistently-sized items, such as envelopes, for example, for sortation. In one embodiment, the items are arranged on the automatic feeder module 12 on edge and advanced using a conveyor 13, for example, towards a feeder belt 14, shown schematically in FIG. 1. Other feeding arrangements may also be used.

In this embodiment, the feeder belt 14 is configured to contact a surface of an approaching item and to redirect the item's direction of travel substantially perpendicularly to advance the item for downstream processing. The feeder belt 14 may feed a single item at a time. Often, however, friction between items causes multiple items to advance. The multiple items may be overlapping to various degrees.

From the feeder module 12, the items are fed to a singulation module 16, which singulates the overlapping items to ensure that only one item at a time is processed by the system. The singulated items are fed through the system 10 for processing by various modules.

The illustrated sortation system 10 also includes an embodiment of the item feeder 11 of the present invention, which provides an additional or alternative means of providing items to the system 10 for processing. Two item feeders 11 are shown in FIG. 1. The item feeders 11 may be used to transport a range of items, including envelopes of various shapes and sizes, as well as larger catalogs and packages, for example. In the illustrated example, items are transported on the item feeders 11 substantially perpendicularly to the main transport path of the sortation system 10. The items are subsequently redirected along the main transport path for processing.

The items provided to the sortation system 10 first pass through a scanning module 18, where an image of at least a portion of each item is obtained. The scanned image may be used by the controller 19 to determine the destination pocket for the item. As discussed above, bins may also be used, depending on the configuration of the sortation system. In the illustrated sortation system 10, the items then pass through a weighing module 20, where the weight of the item is obtained.

In some applications, a sortation system is used to apply markings, such as an address or code, for example, to the face of items being processed. Such markings may be added using a printer or labeler. Both a printing module 22 and a labeling module 24 are included in the illustrated sortation system 10.

Finally, the items are directed to the destination pocket 26 using a diverter module 28. For systems with pockets 26 on multiple levels, an elevator arrangement (not shown) may be used to move the items to the appropriate level.

The item feeder 11 may be utilized with an item handling system, such as a sortation system, for example, to detect when the thickness of items being provided to the system exceeds a predetermined thickness. In some embodiments, the item feeder 11 may be configured to stop transporting items on detection of an excessively thick item. Other embodiments may prevent false overthickness warnings. Accordingly, the item feeder 11 may improve the operating efficiency of the associated item handling system.

Figure 2:
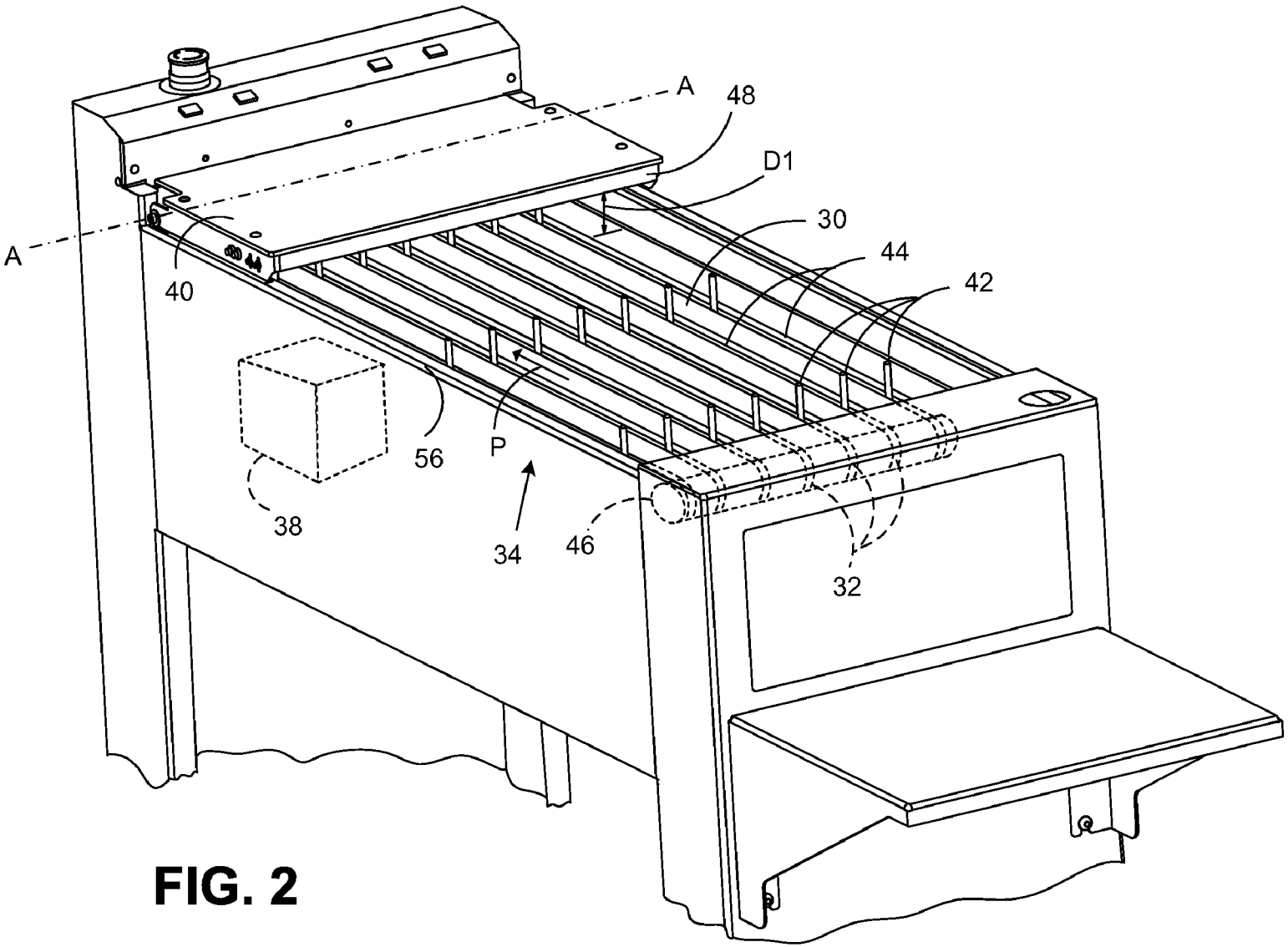
FIG. 2 is a partially schematic perspective view of the item feeder shown in FIG. 1 in a first configuration.
Figure 3:
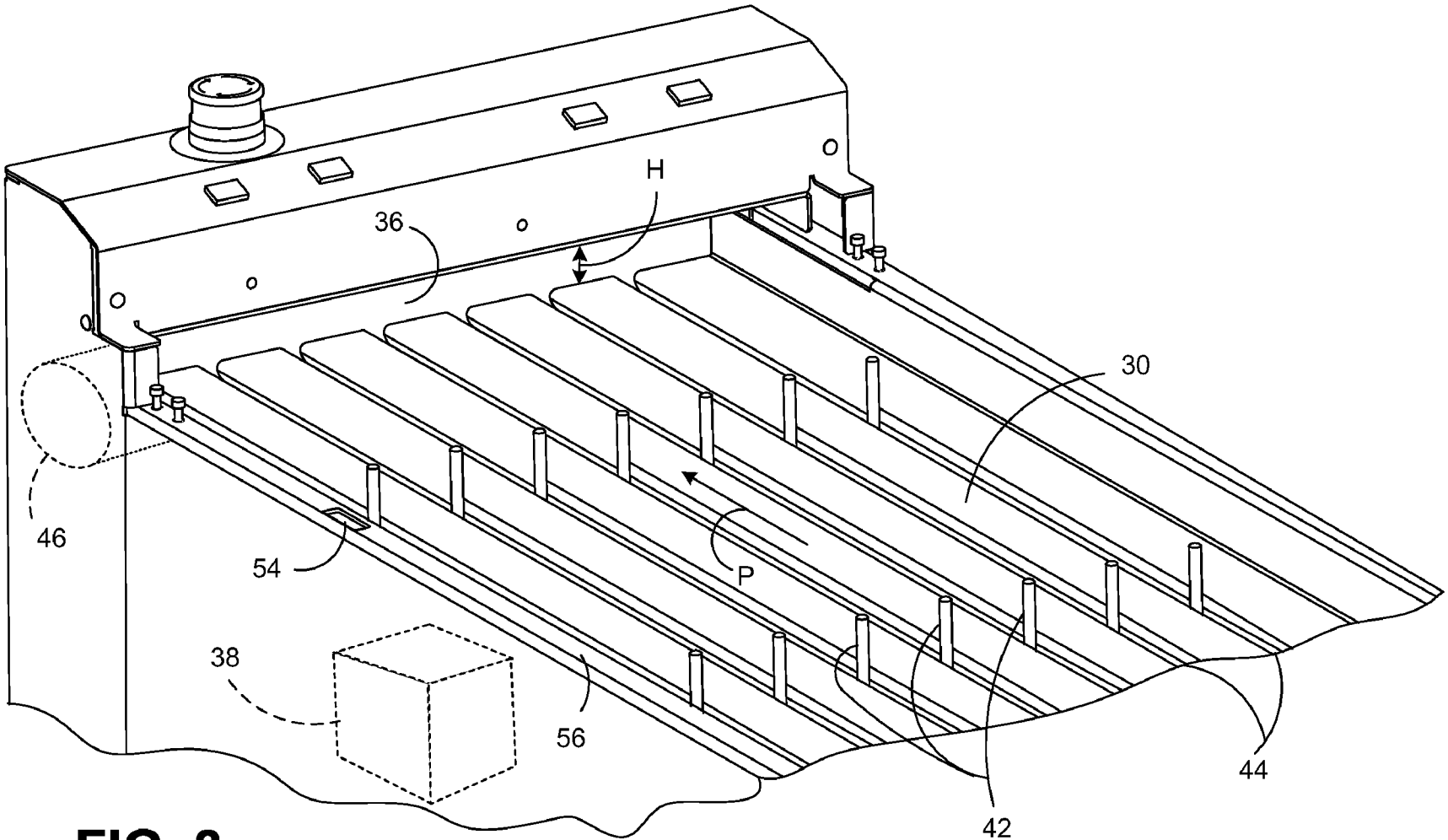
FIG. 3 is a partially schematic perspective view of the item feeder shown in FIG. 1 with the cover element removed.

An embodiment of the item feeder 11 according to the invention is shown in FIG. 2. The item feeder 11 in the illustrated embodiment comprises a deck 30 for supporting items and a transport element 32 for transporting the items along the deck 30 on a transport path P from an upstream loading area 34 through a downstream receiving passage 36. The downstream receiving passage 36 is shown in FIG. 3, which illustrates an embodiment of the item feeder 11 with the cover element 40 removed. The item feeder 11 further comprises a drive element 38 for driving the transport element 32, and a cover element 40.

In the illustrated embodiment, the transport element 32 comprises a plurality of transport elements and a plurality of item contact elements 42 associated with each transport element 32 for engaging a portion of respective items to transport the items with the transport elements 32. The transport elements 32 shown in FIG. 2 comprise belts. In other embodiments, the transport elements 32 may comprise O-rings, toothed belts, chains, or other drive elements. In addition, the item feeder 11 illustrated herein comprises seven transport elements 32. Item feeders 11 having more or fewer transport elements 32 may also be used.

As shown, the item contact elements 42 comprise pushers configured to engage a rear surface of respective items. The item contact elements 42 may be formed integrally with the transport elements 32 or may be formed separately and attached to the transport elements 32. Other item contact elements 42, such as grippers, for example, may also be used. In addition, the item contact elements 42 may be arranged on the transport elements 32 at larger or smaller spaced intervals. A consideration for the spacing of the item contact elements 42 may be the size of the items the system will be processing. In the illustrated embodiment, the item contact elements 42 are received in slots 44 in the deck 30.

As discussed above, the item feeder 11 comprises a drive element 38 for driving the transport elements 32. In the illustrated embodiment, the item feeder 11 further comprises a plurality of support elements 46 rotatably supporting the transport elements 32. In one embodiment, the support elements 46 comprise a pulley proximate to the drive element 38 and a smooth roller proximate to the loading area 34. Other types of support elements 46 may also be used, depending on the type of transport elements 32 used. In addition, two support elements 46 are shown, but drive arrangements utilizing other numbers of support elements may also be used.

In the illustrated embodiment, the drive element 38, comprising a single DC motor, is used to drive one of the support elements 46. Other drive arrangements may also be used. Control of the drive element 38 is provided using the controller 19, shown in FIG. 1. In one example, the controller 19 for the item feeder 11 may comprise an enhanced small module controller configured as an electronics card. Such an arrangement is known as an ESMC card. Other controller arrangements may also be used.

The cover element 40, shown in FIG. 2, comprises a leading edge 48. The cover element 40 is movable between a closed position, in which the leading edge 48 is disposed at a first distance D1 from the deck, and an open position, in which the leading edge 48 is disposed at a second greater distance D2 from the deck. The cover element 40 is shown in the closed position in FIG. 2 and in the open position in FIG. 4.

In the illustrated embodiment, the cover element 40 is pivotably mounted about an axis A substantially perpendicular to the transport path P. Other arrangements may also be used.

Figure 5:
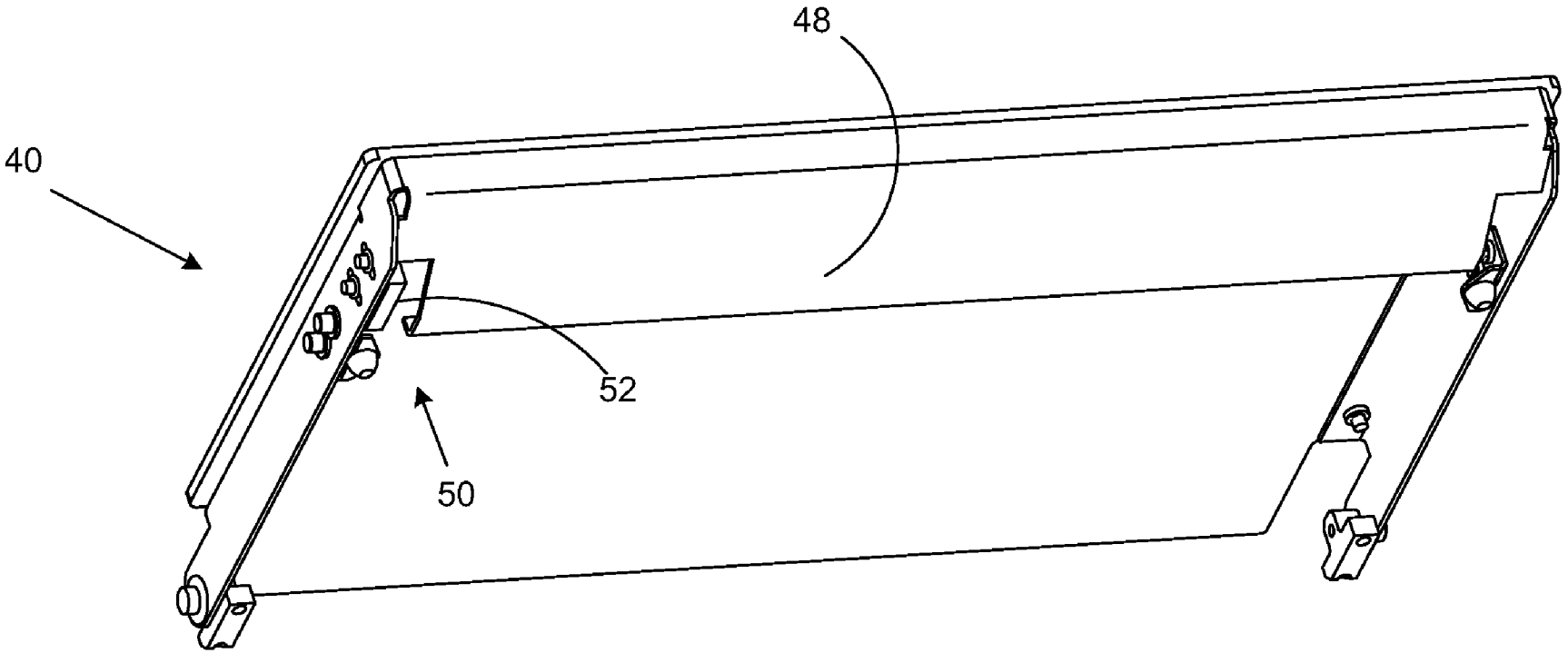
FIG. 5 is a perspective view of an embodiment of the cover element of the present invention.

The leading edge 48 of the cover element 40 is configured to engage transported items having a thickness greater than the first distance D1 to move the cover element 40 out of the closed position. In one embodiment, the leading edge 48 comprises an angled contact surface, shown in FIG. 5. Items engaging the leading edge 48 act against the weight of the cover element 40 to move the cover element 40 out of the closed position.

Figure 6:
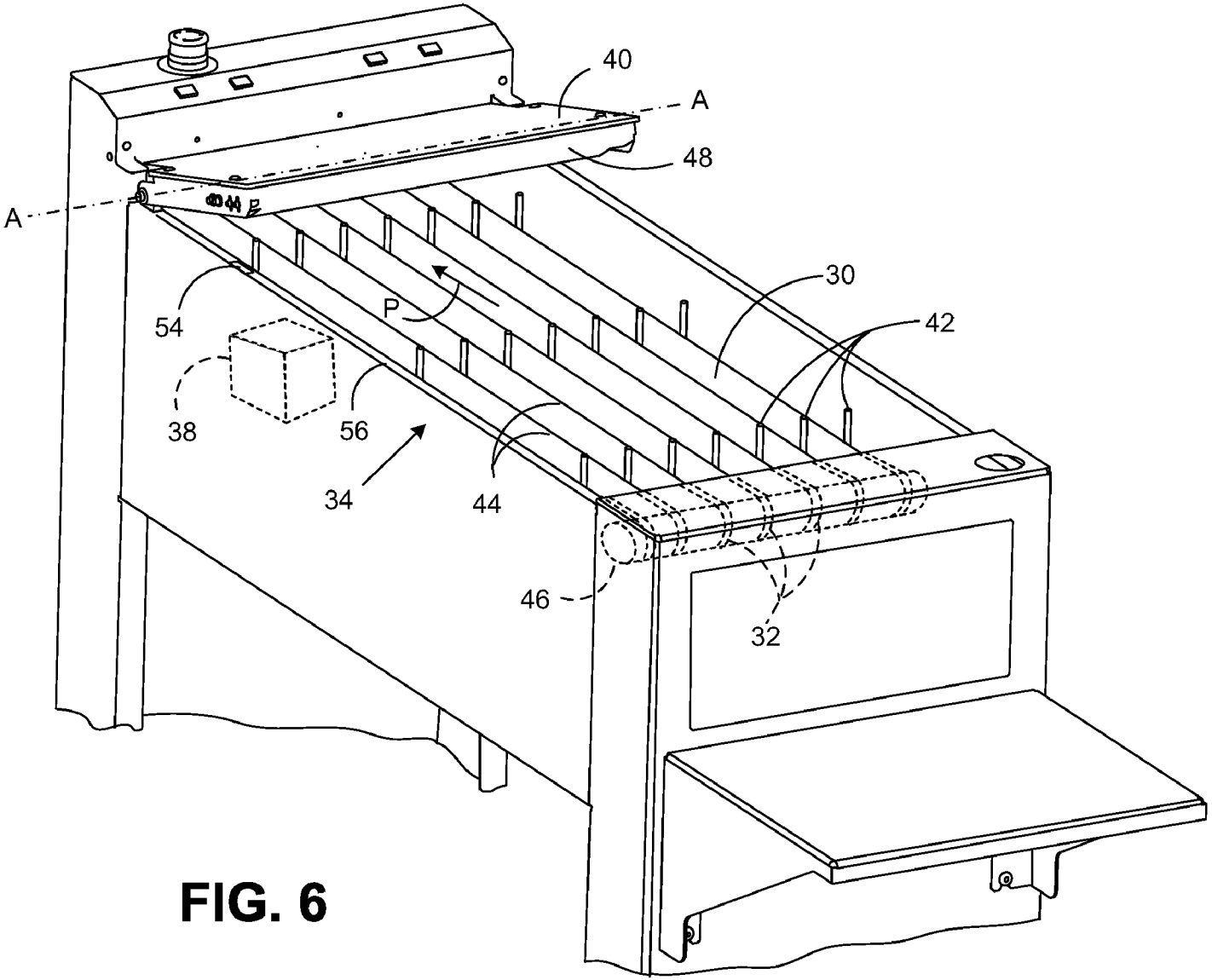
FIG. 6 is a partially schematic perspective view of the item feeder shown in FIG. 1 in a third configuration.

As discussed above, the drive element 38 is controlled using the controller 19. In one arrangement, the controller 19 is configured to stop the drive element 38 when the cover element 40 is moved out of the closed position. Thus, when a transported item having a thickness greater than the first distance D1 engages the leading edge 48 of the cover element 40, that engagement causes the cover element 40 to move out of the closed position to the configuration shown in FIG. 6.

The item feeder 11 further comprises a sensor 50 associated with the cover element 40 for detecting displacement of the leading edge 48. In one embodiment, shown in FIGS. 4-6, the sensor 50 comprises a first component 52 disposed on the cover element 40 and a second component 54 disposed on a housing 56 proximate to the deck 30. The sensor 50 in that embodiment may comprise a contact sensor or a proximity sensor. Other types of sensors may also be used.

The sensor 50 provides a status signal to the controller 19 indicating whether the leading edge 48 of the cover element 40 is disposed at the first distance D1 from the deck. The first distance D1 may be varied by adjusting the position of either or both of the first component 52 and the second component 54 of the sensor 50. Such an adjustment may be made based on the expected thickness of the items being processed or based on a requirement of a downstream processing module, for example.

When the cover element 40 is moved out of the closed position, the sensor 50 sends a signal to the controller 19 indicating that status. In one embodiment, the controller 19 stops the drive element 38 based on the signal from the sensor 50.

The downstream receiving passage 36 is shown in FIG. 3. As shown, the height H of the receiving passage 36 is at least as large as the first distance D1. In some embodiments, the height H of the receiving passage 36 is larger than the first distance D1. In one example, the receiving passage 36 had a height of approximately 1.75 inches and the first distance D1 was approximately 1.625 inches. Other sizes may also be used. The height H of the receiving passage 36 may be designated based on the maximum thickness of items the sortation system is configured to process. Accordingly, an item having a thickness exceeding the maximum thickness of the system would be physically restricted from entering the receiving passage 36.

Figure 4:
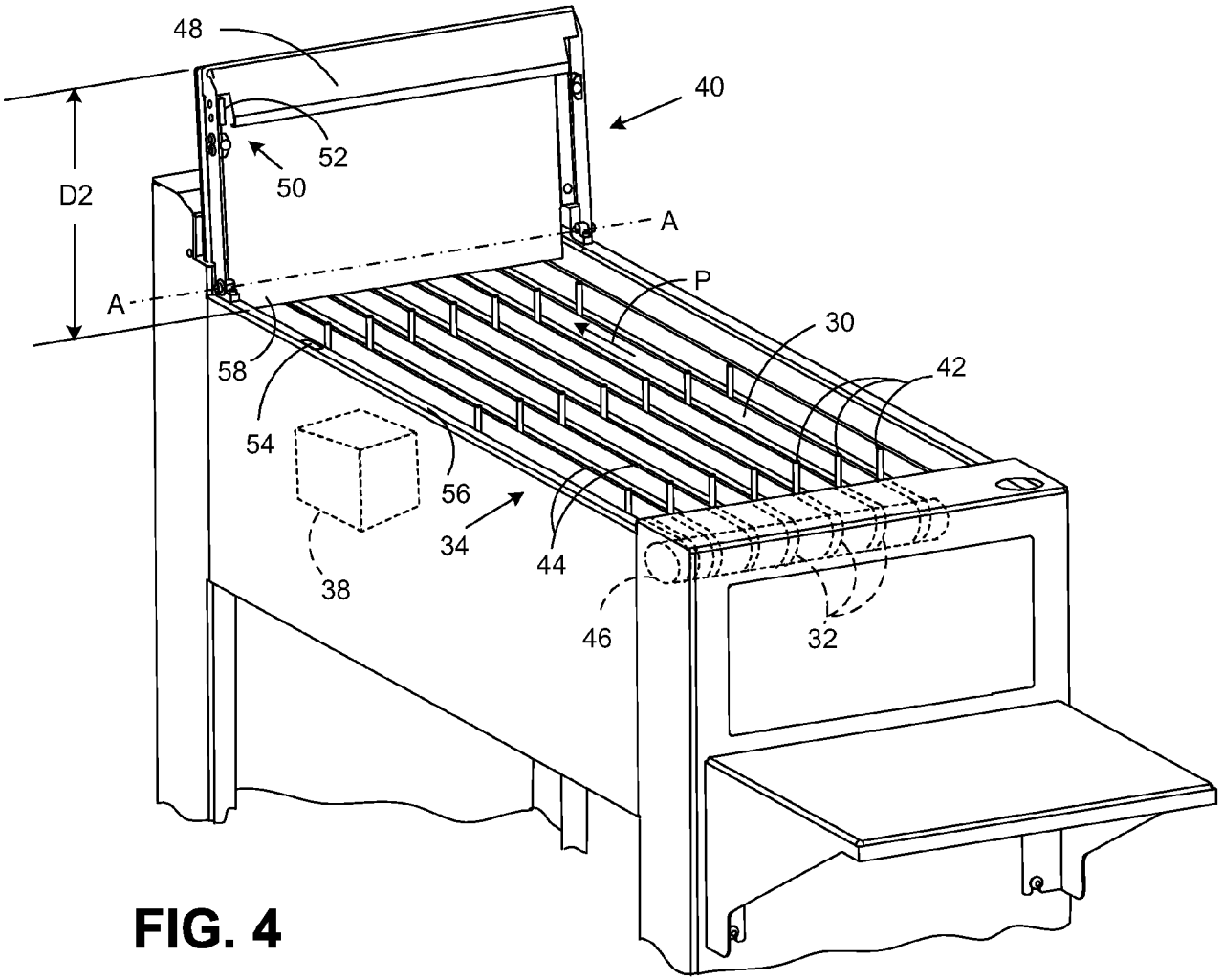
FIG. 4 is a partially schematic perspective view of the item feeder shown in FIG. 1 in a second configuration.

In the illustrated embodiment, the cover element 40 comprises a blocking portion 58 configured to impede access to the receiving passage 36 when the cover element 40 is in the open position, shown in FIG. 4. The blocking portion 58 of the cover element 40 is disposed on a side of the axis A opposite to the leading edge 48. The receiving passage 36 may comprise an intersection of belts and rollers, for example. The cover element 40 in the closed position limits access to the receiving passage 36. Blocking access to that potentially hazardous area when the cover element 40 is open may provide additional protection for an operator of the sortation system 10.

An example of the operation of the item feeder 11 of the invention will now be described in which a single operator transports items on a single item feeder 11. It is understood, however, that multiple item feeders 11 may be used by multiple operators in concert to transport items in a variety of coordinated arrangements. In addition, as discussed above, implementations of the item feeder 11 in sortation systems are exemplary only. Embodiments of the item feeder 11 of the invention may be used in association with other systems configured to handle and transport items.

An operator first closes the cover element 40 and loads an item onto the upstream loading area 34 to start the drive element 38. The cover element 40 is shown in the closed position in FIG. 2. The drive element 38 in turn drives at least one of the support elements 46, thereby driving the transport elements 32. The drive element 38 begins to run as directed by the controller 19. For example, the controller 19 may run the drive element 38 continually or periodically, depending on the operating mode of the item feeder 11.

Next, the operator continues loading items, one at a time, onto the upstream loading area 34. Respective loading areas are defined between the item contact elements 42.

Items having a thickness less than the first distance D1 pass below the leading edge 48 of the cover element 40 without contacting it.

In some cases, items having a thickness less than the first distance D1 are covered with a wrapping, such as a loose polymer wrap or a torn paper wrap, for example, that extends above the deck 30 at a distance that exceeds the first distance D1. In such cases, the weight of the cover element 40, acting through the leading edge 48, forces the wrapping against the item and allows the item to pass beneath the cover element 40 and through the downstream receiving passage 36. That arrangement may eliminate false overthickness indications obtained with conventional devices.

Where desirable, the weight of the cover element 40 may be varied to obtain a different level of force applied by the leading edge 48 on transported items. Alternatively, a biasing element (not shown) may be applied to the cover element 40 to vary the applied force.

Items having a thickness greater than the first distance D1 will be transported along the transport path P as far as the leading edge 48 of the cover element 40. Such items will engage the angled surface of the leading edge 48. As the transport elements 32 transport such items farther along the transport path P, the items will move farther along the leading edge 48, moving the cover element 40 proportionally away from the deck 30.

Once the cover element 40 is moved out of the closed position, the first component 52 of the sensor 50 will lose communication (e.g., contact) with the second component 54 of the sensor 50. The sensor 50 will then send a signal to the controller 19 to stop the drive element 38.

An operator may then move the cover element 40 to the open position and remove the respective item. Once the item has been removed, the operator may close the cover element 40 and allow the controller 19 to start the drive element 38 again.

It will be apparent to those skilled in the art that various modifications and variations can be made to the structure and methodology described herein. Thus, it should be understood that the invention is not limited to the examples discussed in the specification. Rather, the present invention is intended to cover modifications and variations.

What is claimed is:

1. An item feeder, comprising:

a deck for supporting items;

a transport element for transporting the items along the deck on a transport path from an upstream loading area through a downstream receiving passage;

a drive element for driving the transport element;

a cover element comprising a leading edge, wherein the cover element is movable between a closed position in which the leading edge is disposed at a first distance from the deck, and an open position in which the leading edge is disposed at a second greater distance from the deck, and wherein the leading edge is configured to engage transported items having a thickness greater than the first distance to move the cover element out of the closed position; and a controller for controlling the drive element, wherein the controller is configured to stop the drive element when the cover element is moved out of the closed position.

2. The item feeder of claim 1, further comprising a plurality of support elements rotatably supporting the transport element, wherein the drive element drives at least one of the support elements.

3. The item feeder of claim 1, wherein the transport element comprises:

a plurality of transport elements; and a plurality of item contact elements associated with each transport element for engaging a portion of respective items to transport the items with the transport elements.

4. The item feeder of claim 1, wherein the leading edge comprises an angled contact surface.

5. The item feeder of claim 1, wherein the cover element is pivotably mounted about an axis substantially perpendicular to the transport path.

6. The item feeder of claim 5, wherein the cover element comprises a blocking portion configured to impede access to the receiving passage when the cover element is in the open position.

7. The item feeder of claim 1, further comprising a sensor associated with the cover element for detecting displacement of the leading edge.

8. The item feeder of claim 7, wherein the sensor comprises a first component disposed on the cover element and a second component disposed on a housing proximate to the deck.

9. The item feeder of claim 7, wherein the controller stops the drive element based on a signal from the sensor.

10. The item feeder of claim 1, wherein a height of the receiving passage is at least as large as the first distance.

11. The item feeder of claim 10, wherein the height of the receiving passage is larger than the first distance.

12. A method of feeding items, comprising:

supporting items on a deck;

transporting the items along the deck on a transport path from an upstream loading area through a downstream receiving passage using a transport element;

driving the transport element using a drive element;

providing a cover element comprising a leading edge, wherein the cover element is movable between a closed position in which the leading edge is disposed at a first distance from the deck, and an open position in which the leading edge is disposed at a second greater distance from the deck, wherein the leading edge is configured to engage transported items having a thickness greater than the first distance to move the cover element out of the closed position; and controlling the drive element using a controller, wherein the controller is configured to stop the drive element when the cover element is moved out of the closed position.

13. The method of claim 12, further comprising rotatably supporting the transport element with a plurality of support elements, wherein the drive element drives at least one of the support elements.

14. The method of claim 12, further comprising detecting displacement of the leading edge using a sensor associated with the cover element.

* * * * *